US009869957B2

(12) United States Patent
Nameki

(10) Patent No.: US 9,869,957 B2
(45) Date of Patent: Jan. 16, 2018

(54) IMAGE FORMING APPARATUS WITH CLEANING FUNCTION FOR INTERMEDIARY TRANSFER MEMBER

(71) Applicant: CANON KABUSHIKI KAISHA, Tokyo (JP)

(72) Inventor: Ryo Nameki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/248,754

(22) Filed: Aug. 26, 2016

(65) Prior Publication Data

US 2017/0060037 A1 Mar. 2, 2017

(30) Foreign Application Priority Data

Aug. 31, 2015 (JP) ..... 2015-171508

(51) Int. Cl.

*G03G 15/00* (2006.01)
*G03G 15/16* (2006.01)
*G03G 21/20* (2006.01)

(52) U.S. Cl.

CPC ..... *G03G 15/5054* (2013.01); *G03G 15/161* (2013.01); *G03G 21/20* (2013.01); *G03G 2215/00772* (2013.01); *G03G 2215/1661* (2013.01)

(58) Field of Classification Search

CPC ..... G03G 15/5054; G03G 15/161
USPC ..... 399/44
See application file for complete search history.

(56) References Cited

U.S. PATENT DOCUMENTS

| | | | | |
|---|---|---|---|---|
| 6,631,249 | B2 | 10/2003 | Katsumi et al. | |
| 7,991,309 | B2 | 8/2011 | Hiroi | |
| 8,962,133 | B2 | 2/2015 | Sato et al. | |
| 2002/0044798 | A1* | 4/2002 | Katsumi | G03G 15/161 399/297 |
| 2012/0275807 | A1* | 11/2012 | Kanari | G03G 15/161 399/58 |
| 2013/0149540 | A1* | 6/2013 | Sato | G03G 15/162 428/411.1 |

FOREIGN PATENT DOCUMENTS

| | | | |
|---|---|---|---|
| JP | 4124987 | B2 | 7/2008 |
| JP | 2010-122468 | A | 6/2010 |
| JP | 4626678 | B2 | 2/2011 |
| JP | 2014-081603 | A | 5/2014 |

* cited by examiner

*Primary Examiner* — Quana M Grainger
(74) *Attorney, Agent, or Firm* — Fitzpatrick, Cella, Harper & Scinto

(57) ABSTRACT

An image forming apparatus includes an image forming portion for forming a toner image; an intermediary transfer belt for receiving the toner image; a blade for cleaning the belt by removing residual toner therefrom; an ambient condition sensor for detecting an ambient condition; a memory for storing information relating to a use amount of the belt; and a controller for executing an operation in a mode in which a toner is deposited on the belt in an area corresponding to between a preceding sheet and a succeeding sheet during execution of a continuous image forming job for continuously forming the images on the sheets to supply the toner to the blade. The controller controls a frequency of the operations in the mode, on the basis of an output of the sensor during an image formation job and the information stored in the memory.

15 Claims, 7 Drawing Sheets

IMAGE FORMING APPARATUS WITH CLEANING FUNCTION FOR INTERMEDIARY TRANSFER MEMBER

FIELD OF THE INVENTION AND RELATED ART

The present invention relates to an image forming apparatus which uses an electrophotographic method, an electrostatic recording method, or the like.

In a conventional image forming apparatus which uses an electrophotographic recording method, an electrostatic recording method, or the like, an electrostatic latent image is formed on an image bearing member which is an electrophotographic photosensitive member (photosensitive member) or an electrostatically recordable dielectric member, and the electrostatic latent image is developed into a toner image, that is, an image formed of toner, with the use of toner. Then, the toner image formed on the image bearing member is transferred onto such recording medium as a sheet of paper. As a method for transferring the toner image onto recording medium, an intermediary transferring method is available, which transfers (primary transfer) a toner image from an image bearing member onto an intermediary transferring member, and then, transfers (secondary transfer) the toner image from the intermediary transferring member onto transfer medium.

Next, an image forming apparatus of the so-called intermediary transfer type, which forms an image with the use of an electrophotographic recording method, is described further. Generally speaking, in the case of this type of image forming apparatus, the secondary transfer of a toner image, that is, transfer of a toner image from an intermediary transferring member onto transfer medium, is done by generating a transfer electric field in the secondary transferring portion by applying voltage to the secondary transferring member, which is placed in contact with the intermediary transferring member to form the secondary transferring portion. The secondary transfer residual toner, that is, the toner remaining on the surface of the intermediary transferring member after the secondary transfer, is removed from the surface of the intermediary transferring member, and is recovered, by a cleaning means. As the cleaning means, a cleaning method which scrapes away the secondary transfer residual toner with the use of a cleaning member (cleaning blade) is widely in use. In the case of this method, a cleaning member (cleaning blade) is placed in contact with the intermediary transferring member, and as the intermediary transferring member is moved, the secondary transfer residual toner is scraped away by the cleaning member.

As the intermediary transferring member, an intermediary transfer belt is widely in use, which is a semiconductive endless belt (which hereafter may be referred to simply as "belt"). A typical intermediary transfer belt is a belt formed of a material concocted by dispersing carbon black particles in polyimide or polyamideimide, which is a thermoset resin. This type of intermediary transfer belt can be obtained by forming a thin film of a varnish made by dispersing carbon black particles in polyamide resin, or polyamide acid which is a precursor of polyamide, and sintering the film. In comparison, in recent years, it has been studied to use injection molding to manufacture an intermediary transfer belt with the use of a resinous compound made by dispersing carbon black in thermoplastic resin, because not only can thermoplastic resin be molded by injection molding, but also thermoplastic resin is advantageous from the standpoint of environmental load and cost.

Further, it has been proposed to process the surface of an intermediary transfer belt to improve the belt in transfer characteristic, in order to deal with the demand for higher speed and greater longevity.

There is disclosed in Japanese Laid-open Patent Application No. 2014-81603, an attempt made to increase an intermediary transfer belt in transfer efficiency by reducing the surface layer of the belt in adhesiveness. In this case, the surface layer of the intermediary transfer belt was formed by coating the base layer of the belt with water-repelling or oil-repelling fluorine compound.

On the other hand, ordinarily, the above-described cleaning blade is placed in contact with the surface of an intermediary transfer belt in the so-called counter attitude, that is, such an attitude that the cleaning edge (free edge) of the cleaning blade is on the upstream side of the base portion of the cleaning blade in terms of the moving direction of the belt. Therefore, as the friction between the intermediary transfer belt and cleaning blade becomes excessive, the cleaning blade sometimes buckles, which is problematic. As the reason why the friction becomes excessive, it is possible to list a phenomenon that the cleaning edge of the cleaning blade runs out of lubricant such as toner and additives. One of the available solutions to this problem that the cleaning edge runs out of lubricants, and therefore, the cleaning blade buckles, is to supply the area of contact (which hereafter may be referred to as "cleaning portion") between the cleaning blade and intermediary transfer belt with toner, with preset intervals (Japanese Laid-open Patent Application No. 2010-122468). This method, however, is problematic in that as an operation for supplying the cleaning portion with toner is carried out with excessive frequency, an image forming apparatus significantly increases in the amount of toner consumption and downtime (periods in which image cannot be outputted).

By the way, it became evident that in a case of an intermediary transfer belt, the surface layer of which is a coated layer of fluorine compound, in particular, as described above, there are the following issues.

That is, if an image forming apparatus used to continuously output images, with its cleaning blade kept in contact with its intermediary belt, in an ambience which is high in temperature, is left unattended for a certain length of time, and then, is used again to output images, it sometimes outputs unsatisfactory images, more specifically, images having such an image defect that is in the form of an unwanted stripe which is parallel to the primary scan direction.

Studies made regarding the mechanism to which the occurrence of the above-described phenomenon is attributable revealed the following: in an ambience which is high in temperature, in particular, high enough for the ingredients of the surface layer of the intermediary transfer belt to ooze out of the surface layer, as the ingredients having oozed out are scraped up by the cleaning blade, they sometimes collect along the cleaning edge. With the elapse of a certain length of time, the ingredients which are collected along the cleaning edge solidly adhere to the intermediary transfer belt. Thus, when the image forming apparatus is used for the next image forming operation, it is impossible for an image to be properly transferred onto the portions of the intermediary transfer belt, which have the solidified ingredients having oozed out of the surface layer of the intermediary transfer belt. Thus, the image forming apparatus outputs images which suffer from the image defect which is in the form of a horizontal stripe.

The inventors of the present invention earnestly studied the above-described phenomenon. As a result, it became evident that an image forming apparatus can be prevented from outputting images which suffer from the above-described image defect in the form of an unwanted horizontal stripe, by supplying the cleaning portion (cleaning edge) with toner. However, if the operation for supplying the cleaning portion with toner is carried out with excessive frequency, it significantly increases the image forming apparatus in toner consumption and downtime, which is problematic.

SUMMARY OF THE INVENTION

Thus, the primary object of the present invention is to provide an image forming apparatus which can prevent the occurrence of an image defect, more specifically, an unwanted stripe (parallel to primary scan direction), which occurs in a case where an intermediary transfer belt, the surface layer of which is a coated layer of fluorine compound, is employed by the image forming apparatus, and which is not significantly greater in the amount of toner consumption and downtime than any conventional image forming apparatus. The above-described object can be accomplished by an image forming apparatus which is in accordance with the present invention.

According to an aspect of the present invention, there is provided an image forming apparatus comprising an image forming portion configured to form a toner image; an intermediary transfer member configured to receive the toner image formed by said image forming portion; a blade configured to clean said intermediary transfer member by removing residual toner therefrom; an ambient condition sensor configured to detect an ambient condition of said apparatus; a memory configured to store information relating to a use amount of said intermediary transfer member; a controller configured to execute an operation in a mode in which a toner is deposited on said intermediary transfer member in an area corresponding to between a preceding recording material and a succeeding recording material during execution of a continuous image forming job for continuously forming the images on the recording materials to supply the toner to said blade, wherein said controller controls a frequency of the operations in the mode, on the basis of a detection result of the ambient condition sensor during an image formation job in the information stored in said memory.

According to another aspect of the present invention, there is provided an image forming apparatus comprising an image forming portion configured to form a toner image; an intermediary transfer member configured to receive the toner image formed by said image forming portion, said intermediary transfer member comprises such a material that a component thereof exudes from a surface of said intermediary transfer member under first and second conditions, wherein an amount of the exuding component per unit time is larger in the second condition of an ambient condition than in the first condition of the ambient condition; a blade configured to clean said intermediary transfer member by removing residual toner therefrom; an ambient condition sensor configured to detect an ambient condition of said apparatus; a memory configured to store information relating to a use amount of said intermediary transfer member; a controller configured to execute an operation in a mode in which a toner is deposited on said intermediary transfer member in an area corresponding to between a preceding recording material and a succeeding recording material during execution of a continuous image forming job for continuously forming the images on the recording materials to supply the toner to said blade; wherein said controller executes the operations in the mode at a first frequency when the use amount of said intermediary transfer member is smaller than a first use amount and a detection result of said ambient condition sensor falls in the first condition, during the continuous image forming job, said controller executes the operations in the mode at a second frequency when the use amount of said intermediary transfer member is smaller than a first use amount and a detection result of said ambient condition sensor falls in the second condition, during the continuous image forming job, and said controller executes the operations in the mode at a third frequency when the use amount of said intermediary transfer member is larger than a first use amount irrespective of the detection result of said ambient condition sensor, during the continuous image forming job.

According to a further aspect of the present invention, there is provided an image forming apparatus comprising: an image forming portion configured to form a toner image; an intermediary transfer member configured to receive the toner image formed by said image forming portion; a blade configured to clean said intermediary transfer member by removing residual toner therefrom; a memory configured to store information relating to a use amount of said intermediary transfer member; a controller configured to execute an operation in a mode in which a toner is deposited on said intermediary transfer member in an area corresponding to between a preceding recording material and a succeeding recording material during execution of a continuous image forming job for continuously forming the images on the recording materials to supply the toner to said blade; said controller executes the operations in the mode at a first frequency when the use amount of said intermediary transfer member is smaller than a first use amount, during the continuous image forming job, and at a second frequency when the use amount of said intermediary transfer member is larger than a first use amount, during the continuous image forming job, the second frequency being lower than the first frequency.

Further features of the present invention will become apparent from the following description of exemplary embodiments with reference to the attached drawings.

Figure 4:
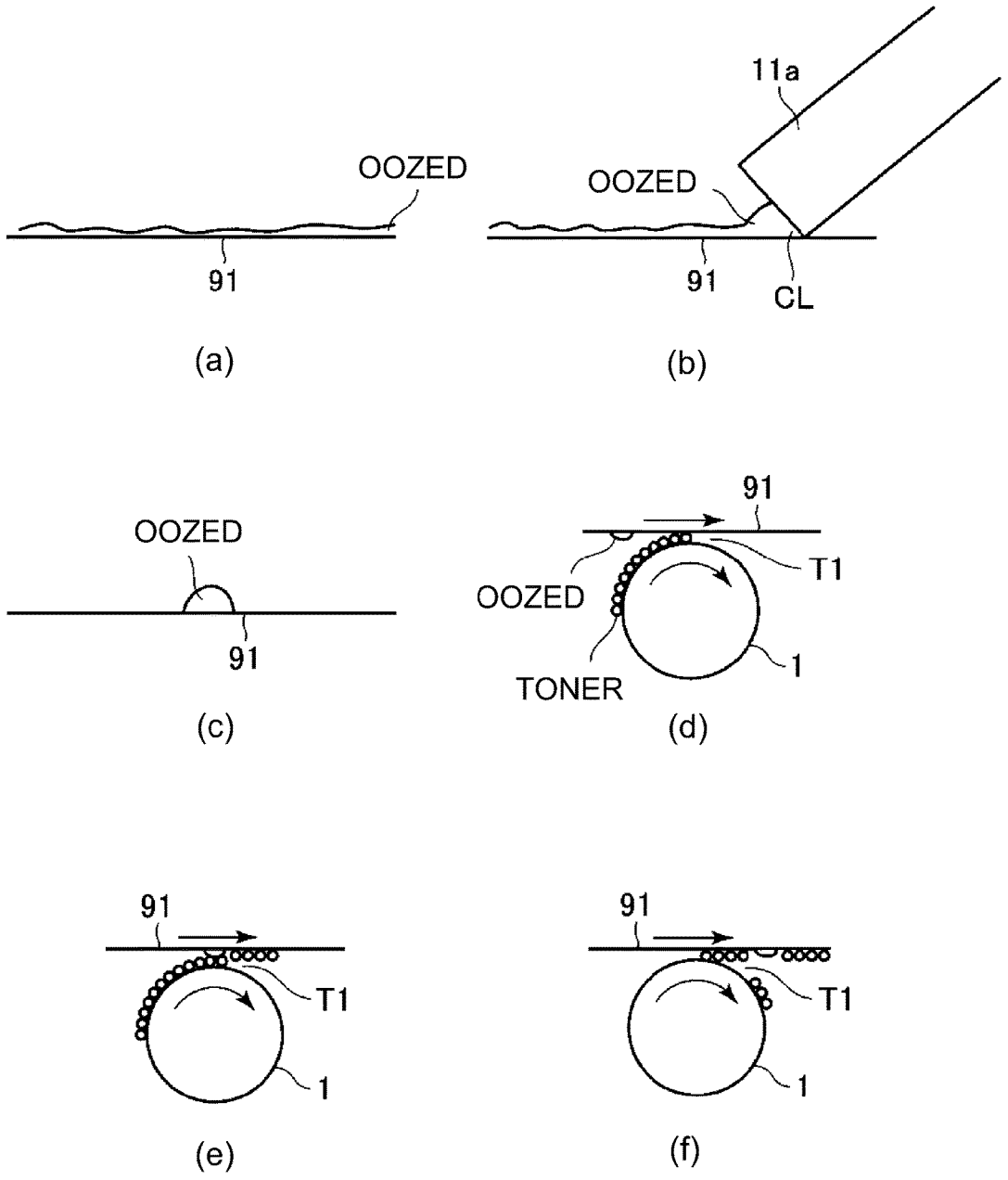

Parts (a), (b), (c), (d), (e) and (f) of FIG. 4 are schematic views showing the mechanism of the occurrence of the image defect which is in the form of an unwanted stripe which is parallel to the primary scan direction.

Figure 5:
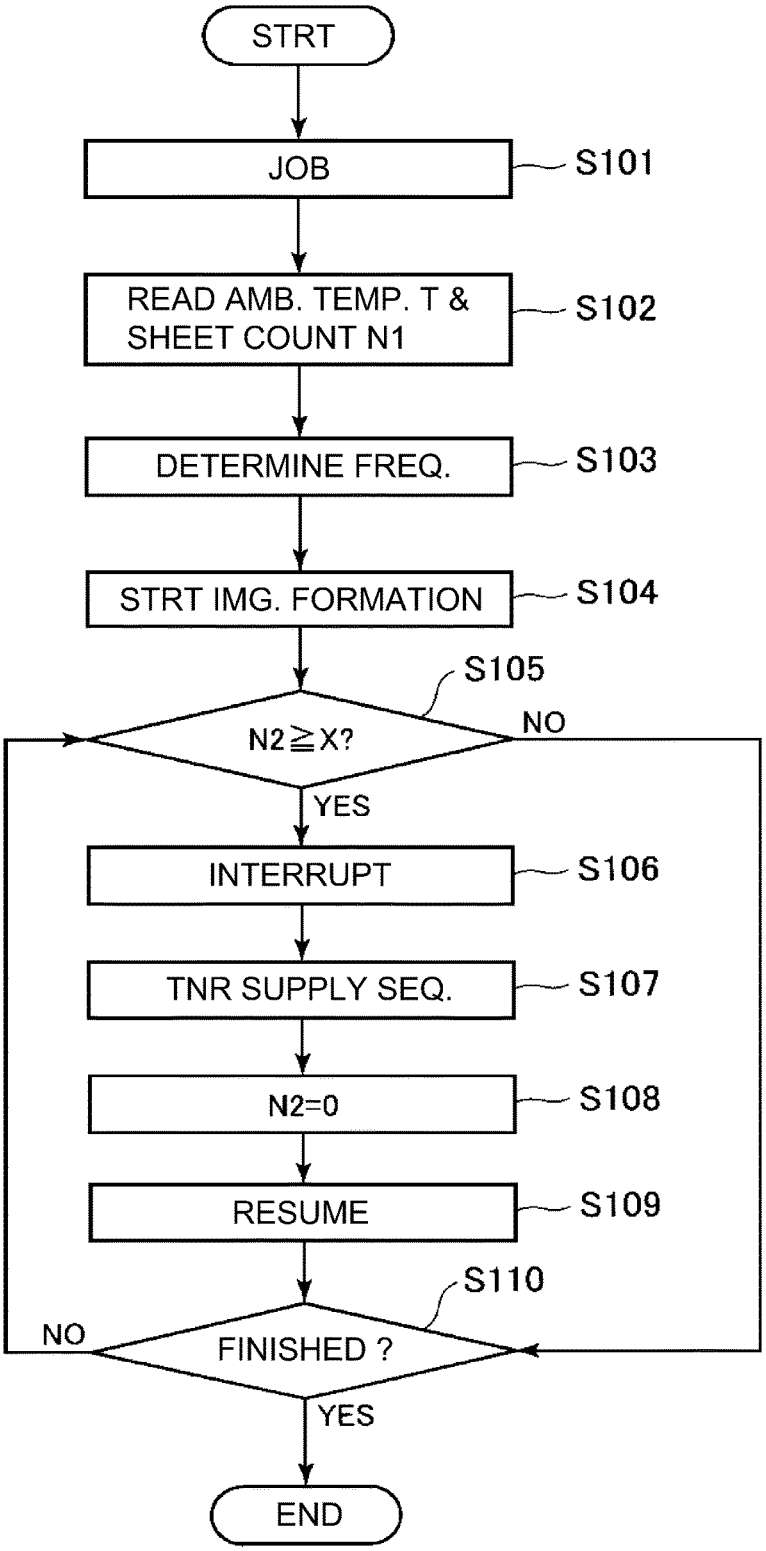

FIG. 5 is a flowchart of an example of toner supply sequence.

Figure 6:
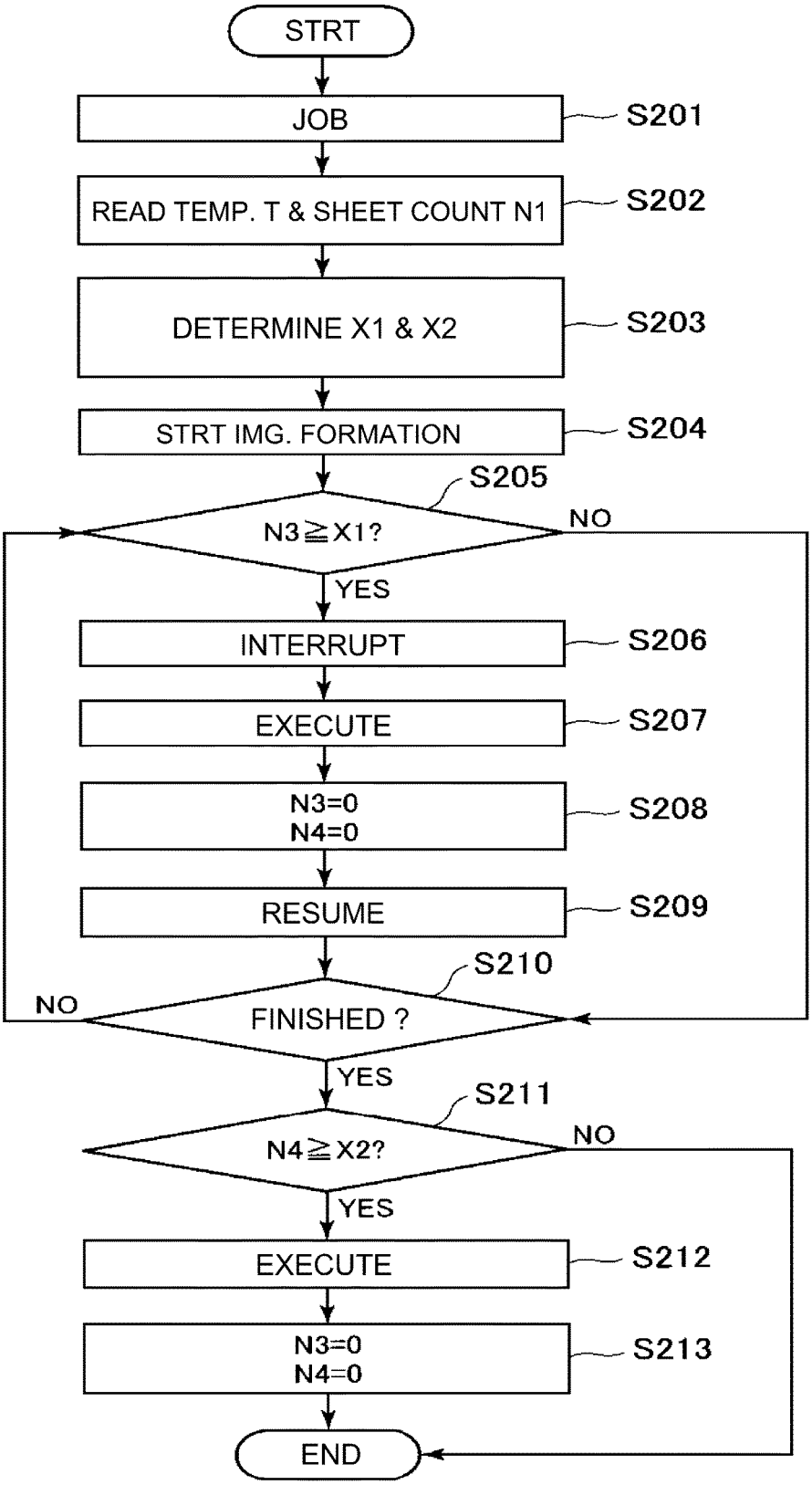

FIG. 6 is a flowchart of another example of toner supply sequence.

Figure 7:
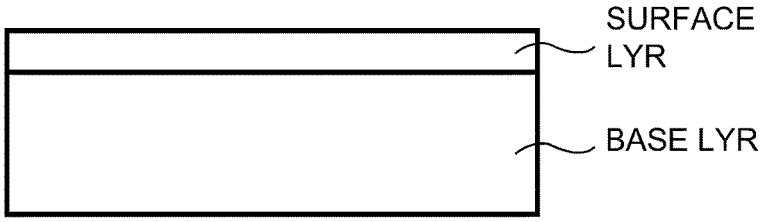

FIG. 7 is a schematic sectional view of the intermediary transferring member.

DESCRIPTION OF THE EMBODIMENTS

Hereinafter, image forming apparatuses which are in accordance with the present invention are described in greater detail with reference to appended drawings.

Embodiment 1

1. Overall Structure and Operation of Image Forming Apparatus

Figure 1:
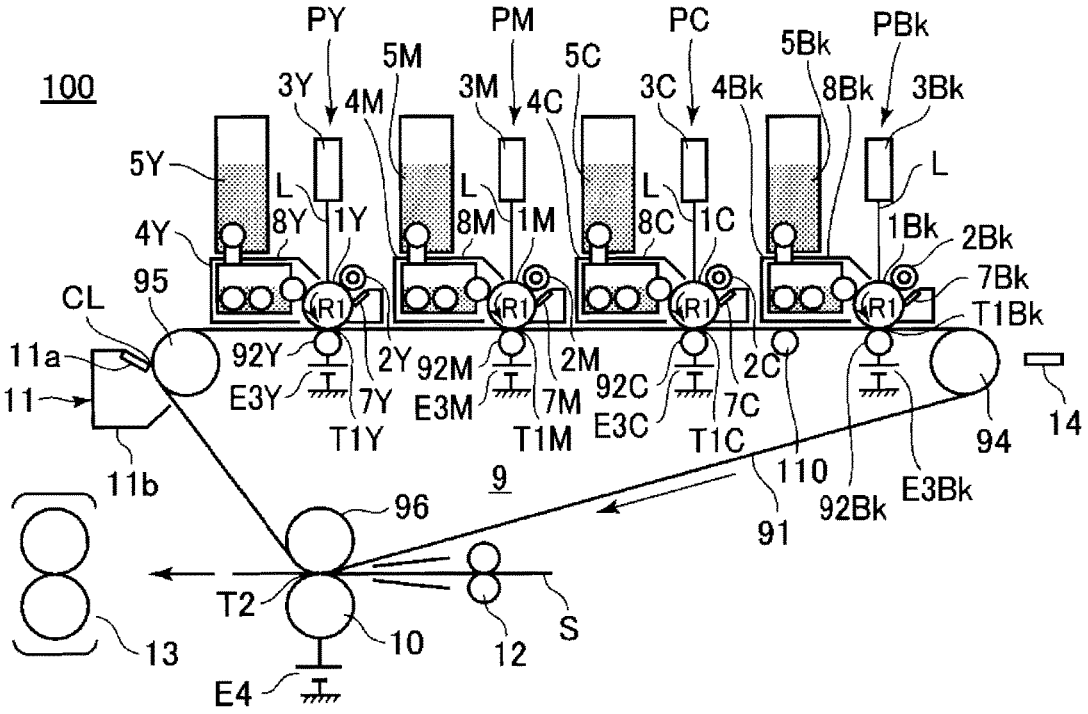
FIG. 1 is a schematic sectional view of a typical image forming apparatus to which the present invention is applicable.

FIG. 1 is a schematic sectional view of the image forming apparatus 100 in one of the preferred embodiments of the present invention. The image forming apparatus 100 in this embodiment is a color laser printer. It is of the so-called transfer type. It uses an electrophotographic process, a charging method of contact type, and a reversal developing method. The size of the largest sheet of recording medium conveyable through the image forming apparatus 100 is A3. It can form a color image on recording medium such as a sheet of recording paper, OHP film, etc., and output the recording medium, in response to image information signals from an external host apparatus which is in connection to the main assembly of the image forming apparatus 100 so that information can be exchanged between the image forming apparatus 100 and external host apparatus.

Figure 2:
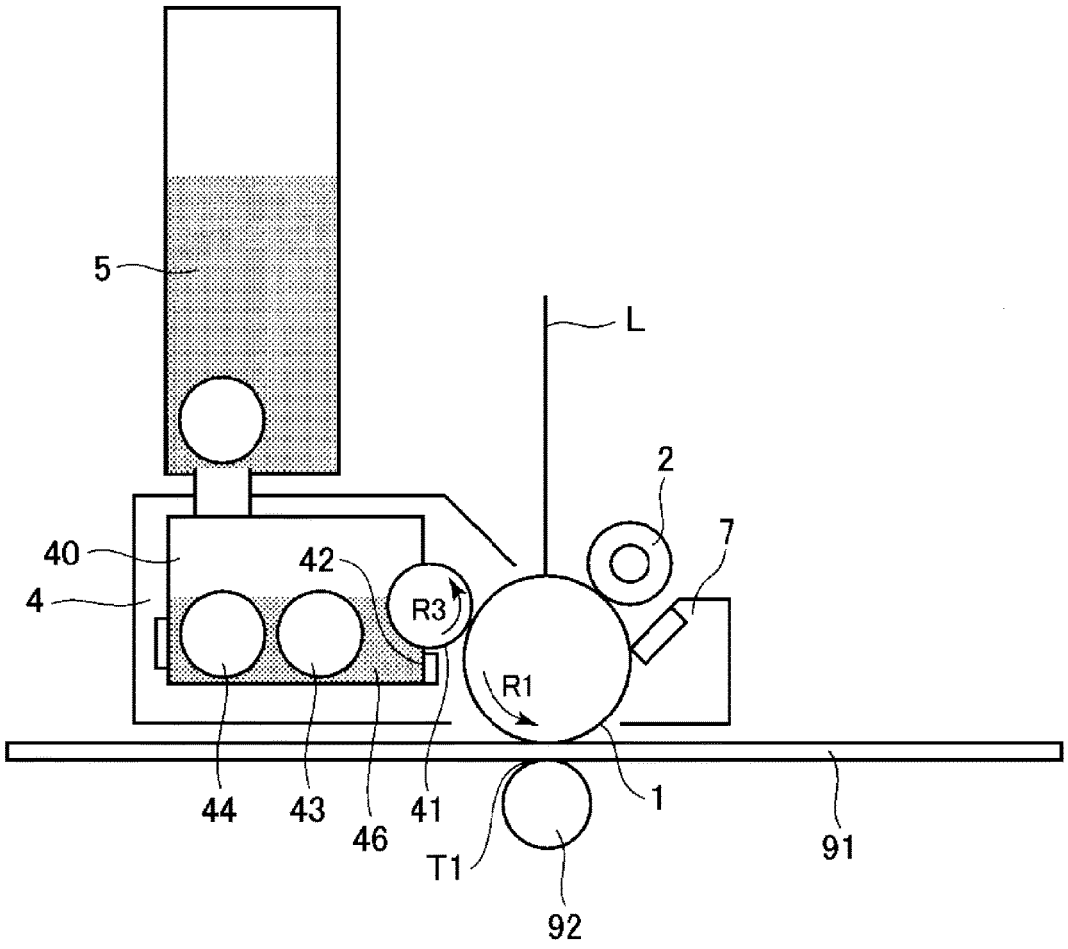
FIG. 2 is a schematic sectional view of the image forming portion (station) of the image forming apparatus shown in FIG. 1.

The image forming apparatus 100 has multiple image forming portions (stations), more specifically, the first, second, third, and fourth image forming stations PY, PM, PC and PBk, which form yellow (Y), magenta (M), cyan (C) and black (Bk) images, respectively. In this embodiment, the image forming portions PY, PM, PC and PBk are practically the same in structure and operation, although they are different in the color of the toner they use. Therefore, unless they need to be differentiated, the referential suffixes which indicate the color of the toner they use are not shown to describe the image forming portions together. FIG. 2 is a schematic sectional view of one of the image forming portions P, which is for describing the image forming portion P in greater detail. In this embodiment, a photosensitive drum 1, a charge roller 2, an exposing device 3, a developing device 4, a primary transfer roller 92, a drum cleaner 7, etc., which will be described later, make up the image forming portion P.

The image forming apparatus 100 has the photosensitive drum 1, which is an electrophotographic photosensitive member (photosensitive member) as an image bearing member. It is in the form of a drum, and is rotatable. In this embodiment, the photosensitive drum 1 is an organic photoconductive member (OPC), which is made up of a conductive supporting member, and a photosensitive layer formed of an organic substance on the peripheral surface of the conductive member. It is 30 mm in external diameter, and 330 mm in length (dimension in terms of direction parallel to its rotational axis). The photosensitive drum 1 is rotationally driven by a drum driving motor D1 (FIG. 3) as a photosensitive member driving member, about its rotational axis at a process speed (peripheral velocity) of 20 mm/sec, in the direction indicated by an arrow mark R1 in the drawing.

As the photosensitive drum 1 is rotated, its peripheral surface is uniformly charged to a preset potential level by the charge roller as a charging means, which is a charging device of the so-called contact type. In this embodiment, the charge roller 2 is 320 mm in length (dimension in terms of direction parallel to its rotational axis). It is made up of a metallic core (supporting member), a base layer formed on the peripheral surface of the metallic core, and a surface layer coated on the peripheral surface of the base layer. It is 14 mm in external diameter. In this embodiment, the metallic core is a piece of round stainless steel rod, which is 6 mm in external diameter. The surface layer is formed of a material made by dispersing carbon in fluorine resin. The charge roller 2 is 104Ω-107Ω in electrical resistance. It is rotatably supported by a pair of bearings at the lengthwise ends of its metallic core. It remains pressed toward the photosensitive drum 1, in such a manner that a preset amount of contact pressure is maintained between its peripheral surface and the peripheral surface of the photosensitive drum 1. The charge roller 2 is rotated by the rotation of the photosensitive drum 1. To the charge roller 2, charge bias (charge voltage) is applied from a high voltage charge bias power source E1 (FIG. 3) as a charge voltage applying means, through the metallic core. The charge bias is oscillatory voltage which is a combination of a preset negative DC voltage, and AC voltage preset in frequency (charge voltage Vdc+Vac). Thus, as the photosensitive drum 1 is rotated, the charge roller 2 uniformly charges the peripheral surface of the photosensitive drum 1 to a preset negative potential level. In this embodiment, the charge bias is an oscillatory voltage, which is a combination of DC voltage which is −500 V in magnitude, and AC voltage which is 1,500 Hz in frequency, 1400 in peak-to-peak voltage, and sinusoidal in waveform. Thus, the peripheral surface of the photosensitive drum 1 is uniformly charged to −500 V (pre-exposure potential level Vd).

After being charged, the photosensitive drum 1 is scanned (exposed) by the exposing device 3 as an exposing means, whereby an electrostatic latent image is effected on the peripheral surface of the photosensitive drum 1, in accordance with image information related to one of color components which correspond to image forming portions PY, PM, PC and PBk, one for one. The exposing device 3 has: an optical system which separates an original (color image) into primary color components; a scanning (exposing) optical system which outputs a beam of laser light while modulating the beam with sequential electrical digital signals which reflect the image information obtained through the separation of the original into the primary color component; etc. In this embodiment, the exposing device 3 is a laser beam scanner 3 which employs a semiconductor laser. The exposing device 3 outputs a beam L of laser light while modulating the beam L with image formation signals sent to the image forming apparatus 100 from an image reading device (unshown), to scan (expose) the uniformly charged peripheral surface of the rotating photosensitive drum 1. As the uniformly charged peripheral surface of the photosensitive drum 1 is scanned by (exposed to) the beam L of laser light, exposed points of the peripheral surface of the photosensitive drum 1 reduce in potential level, in terms of absolute value. Consequently, an electrostatic latent image (electrostatic image) which reflects the image information related to one of the primary components of the original (image to be formed), which correspond to image forming portions PY, PM, PC and PBk, is formed on the peripheral surface of photosensitive drum 1. In this embodiment, as a given charged point is exposed, its potential reduces to −150 V (V1). By the way, in this embodiment, the length of the largest (longest) image, in terms of the lengthwise direction of the photosensitive drum 1, which the exposing device 3 can form, is 305 mm.

After an electrostatic latent image is formed on the photosensitive drum 1, it is developed into a visible image (image formed of toner) by the developing device 4, as a developing means, with the use of toner. That is, a toner image is formed on the photosensitive drum 1. In this embodiment, the developing device 4 has: a casing 40; a development sleeve 41, as a developer bearing member, which contains a stationary magnetic roller; and a developer regulating blade 42 as a developer regulating member. Further, the developing device 4 contains in its casing 40, two-component developer 46, which is a mixture of primarily, resinous toner particles (toner), and magnetic carrier particles (carrier). Further, the developing device 4 has a pair of stirring screws 43 and 44, which are disposed in the bottom portion of the casing 40.

The development sleeve 41 is rotatably disposed in the casing 40, with its peripheral surface being partially exposed from the casing. In this embodiment, the peripheral surface of the development sleeve 41 is coated with developer, by a width of 310 mm, in terms of the lengthwise direction of the development sleeve (direction parallel to its rotational axis). The development sleeve 41 is rotationally driven by a developing device driving motor D3 (FIG. 3) as a developing device driving means, in the direction (counterclockwise direction) indicated by an arrow mark R3 in the drawing. The aforementioned developer regulating blade 42 is disposed so that a preset amount of gap is provided between itself and the peripheral surface of the development sleeve 41. Thus, as the development sleeve 41 is rotated, a thin layer of developer is formed on the peripheral surface of the development sleeve 41. In this embodiment, the development sleeve 41 is disposed close to the photosensitive drum 1, more specifically, so that the smallest distance (S-Dgas) between the peripheral surface of the development sleeve 41 and the peripheral surface of the photosensitive drum 1 is 350 μm. The area in which the distance between the peripheral surface of the photosensitive drum 1 and that of the development sleeve 41 is smallest, and the immediate adjacencies thereof, make up the developing portion. The development sleeve 41 is rotationally driven so that the direction in which its peripheral surface moves in the developing portion becomes opposite from the direction in which the peripheral surface of the photosensitive drum 1 moves in the developing portion. The thin layer of developer on the development sleeve 41 contacts and rubs the peripheral surface of the photosensitive drum 1, in the developing portion. To the development sleeve 41, preset development bias (development voltage) is applied from a development high voltage power source E2 as a development voltage applying means. In this embodiment, to the development sleeve 41, an oscillatory voltage, which is a combination of DC voltage (Vdc) and AC voltage (Vac), is applied as the development bias. More concretely, the oscillatory bias is a combination of DC voltage (Vdc) which is −350 V, and AC voltage (Vac) which is 1,800 V in peak-to-peak voltage, 11 kHz in frequency.

As the development sleeve 41 is rotated, developer is coated in a thin layer on the peripheral surface of the development sleeve 41, and then, is conveyed to the developing portion. In the developing portion, the toner particles in the thin layer of toner are made to selectively adhere to various points of the electrostatic latent image on the peripheral surface of the photosensitive drum 1, by the electric field created by the development bias. Consequently, the electrostatic latent image is developed into a visible image formed of toner, which hereafter will be referred to as a toner image. In this embodiment, as the peripheral surface of the photosensitive drum 1 is exposed after being uniformly charged, exposed points of the uniformly charged portion of the peripheral surface of the photosensitive drum 1 reduce in potential level in terms of absolute value. It is to these points having reduced in potential level that toner particles having been charged to the same polarity as that of the photosensitive drum 1 adhere (reversal development). As the development sleeve 41 is rotated, the thin layer of developer on the peripheral surface of the development sleeve 41 is moved through the developing portion, and then, is returned to the developer pool in the casing 40. Meanwhile, the stirring screws 43 and 44 are rotated in synchronism with the rotation of the development sleeve 41, whereby the toner supplied into the casing 40 from the toner supply unit 5 is mixed with the developer (carrier), being thereby given preset electric charge. In this embodiment, negatively chargeable toner which is 5.5 μm in average particle diameter was used as the toner. Further, in this embodiment, magnetic carrier which is 205 emu/$cm^3$ in saturation magnetization, and 35 μm in average particle diameter, was used as the carrier. Further, such developer that was created by mixing the toner and carrier at a weight ratio of 6:94 was used as the developer.

An intermediary transfer unit 9 is disposed so that it opposes the photosensitive drum 1 in each image forming portion P. The intermediary transfer unit 9 has an intermediary transfer belt 91, as an intermediary transferring member, which is an endless belt. The intermediary transfer belt 91 is suspended and kept in tension by a combination of a tension roller 94, a driver roller 95, and a belt-backing roller 96 (which opposes the secondary transfer roller), so that it is provided with a preset amount of tension. As the driver roller 95 is rotationally driven by a belt driving motor D2 (FIG. 2) as an intermediary transferring member driving means, the intermediary transfer belt 91 rotates in the direction (clockwise direction) indicated by an arrow mark R2 in the drawing. In this embodiment, the width (dimension in terms of direction which is roughly perpendicular to belt conveyance direction) of the intermediary transfer belt 91 is the same as, or greater than, the length of the photosensitive drum 1. On the inward side of the loop which the intermediary transfer belt 91 forms, a primary transfer roller 92, as a primary transferring means, which is the primary transferring member, is disposed so that it opposes the photosensitive drum 1. The primary transfer roller 92 is kept pressed toward the photosensitive drum 1, with the presence of the intermediary transfer belt 91 between itself and the photosensitive drum 1, forming thereby the primary transferring portion T1 which is the area of contact between the photosensitive drum 1 and intermediary transfer belt 91. The primary transfer roller 92 of each image forming portion P is in connection to a primary transfer high voltage power source E3, as the primary transfer voltage applying means, which is capable of applying primary transfer bias (primary transfer voltage), independently from the other primary transfer roller 92. In this embodiment, the primary transfer roller 92 is a roller having a surface layer formed of electrically conductive sponge. It is no more than $10^6\Omega$ in electrical resistance, 16 mm in external diameter, and 315 mm in length (dimension in terms of direction parallel to its rotational axis). Further, on the outward side of the loop of the intermediary transfer belt 91, a secondary transfer roller 10, as the secondary transferring means, is disposed so that it opposes the aforementioned belt-backing roller 96. The secondary transfer roller 10 is kept pressured toward the belt-backing roller 96, forming thereby a secondary transferring portion T2, which is the area of contact between the intermediary transfer belt 91 and secondary transfer roller 10. The secondary transfer roller 10 is in connection to a secondary transfer high voltage power source E4, as the secondary transfer voltage applying means. In this embodiment, the secondary transfer roller 10 is similar in structure to the primary transfer roller 92. Also on the outward side of the loop of the intermediary transfer belt 91, the belt cleaner 11 is disposed as the intermediary transferring member cleaning means, so that it opposes the driver roller 95.

A toner image formed on the photosensitive drum 1 is electrostatically transferred (primary transfer) onto the intermediary transfer belt 91, in the primary transferring portion T1. During this process, preset primary transfer bias, which is opposite in polarity from the toner charge (normal toner charge, which is positive in this embodiment) is applied to the primary transfer roller 92. For example, in an operation for forming a full-color image, image formation signals, which correspond to color components of the image to be formed, are generated in response to the signals transmitted to the image forming apparatus 100 from an external host apparatus which is in connection to the image forming apparatus 100 so that signals can be transmitted between the two apparatuses. In response to these signals, yellow, magenta, cyan and black images are formed on the photosensitive drums 1Y, 1M, 1C and 1Bk, respectively. Then, these images are sequentially transferred in layers onto the intermediary transfer belt 91. In this embodiment, in consideration of the efficiency with which the toner particles having adhered to the exposed points (V1=−150) of the peripheral surface of the photosensitive drum 1 will be transferred onto the intermediary transfer belt 91, −350 V of voltage is applied as the primary transfer bias to all the photosensitive drums 1Y, 1M, 1C and 1Bk, which correspond to yellow, magenta, cyan and black color components, respectively. Primary transfer residual toner, that is, the toner remaining on the peripheral surface of the photosensitive drum 1 after the primary transfer, is removed from the peripheral surface of the photosensitive drum 1, and is recovered, by a drum cleaner 7. The drum cleaner 7 has a cleaning blade, as a cleaning member, which is disposed in contact with the peripheral surface of the photosensitive drum 1. The cleaning blade is a rectangular piece of plate formed of elastic substance such as urethane rubber or the like. It is disposed so that it extends in the lengthwise direction of the photosensitive drum 1. Its length (dimension in terms of direction which is roughly parallel to lengthwise direction of photosensitive drum 1) is 322 mm.

A toner image formed on the intermediary transfer belt 91 is electrostatically transferred (secondary transfer) onto a sheet S of transfer medium, in the secondary transferring portion T2. During this process, secondary transfer bias (positive in polarity), which is opposite in polarity from the normal toner charge, is applied to the secondary transfer roller 10. A sheet S of transfer medium is fed into the main assembly of the image forming apparatus 100 from a transfer medium feeding-conveying means (unshown), and is delivered to the secondary transferring portion T2 by a conveyance roller 12 as a conveying means, with such timing that it arrives at the secondary transferring portion T2 at the same time as the toner images on the intermediary transfer belt 91.

The adherent contaminants, such as the secondary transfer residual toner, which is the toner remaining on the surface of the intermediary transfer belt 91 after the secondary transfer, are removed from the surface of the intermediary transfer belt 91, and recovered, by a belt cleaner 11. The belt cleaner 11 has: a cleaning blade 11*a*, as a cleaning member, which cleans the surface of the intermediary transfer belt 91 by being placed in contact with the outward surface of the intermediary transfer belt 91; and a casing 11*b*. The cleaning blade 11*a* is a rectangular piece of plate formed of an elastic substance, such as urethane rubber or the like. It is disposed so that it extends in the widthwise direction of the intermediary transfer belt 91. Further, the cleaning blade 11*a* is disposed in contact with the outward surface of the intermediary transfer belt 91 in such an attitude that its cleaning edge (free edge) is on the upstream side of its base side in terms of the direction in which the surface of the intermediary transfer belt 91 moves. The length (dimension in terms of widthwise direction of intermediary transfer belt 91) of the cleaning blade 11*a* is the same as the width of the intermediary transfer belt 91. As the intermediary transfer belt 91 is moved, the surface of the intermediary transfer belt 91 is scraped by the cleaning blade 11*a*, whereby the adherent contaminants, such as the secondary transfer residual toner, on the surface of the intermediary transfer belt 91 are scraped away from the surface of the intermediary transfer belt 91 by the cleaning blade 11*a*, and are stored in the casing 11*b*.

A sheet S of transfer medium to which a toner image was transferred is conveyed to a fixing device 13 as a fixing means. The fixing device 13 thermally fixes the toner image to the sheet S by applying heat and pressure to the sheet S and the toner image thereon. Thereafter, the sheet S is discharged (outputted) from the main assembly of the image forming apparatus 100.

In this embodiment, each image forming portion is in the form of a process cartridge 8 which comprises: the photosensitive drum 1; and the means for processing the photosensitive drum 1, which are the charge roller 2, developing device 4, and drum cleaner 7. The process cartridge 8 is removably installable in the main assembly of the image forming apparatus 100. In this embodiment, the process cartridges 8 are aligned in tandem in the moving direction of the intermediary transfer belt 91, at a pitch of 102 mm, in the order of yellow, magenta, cyan and black image forming portions. In this embodiment, each of the image forming portions PY, PM, PC and PBk makes up a toner image forming means for forming a toner image on the intermediary transfer belt 91.

2. Intermediary Transfer Belt

Next, the intermediary transfer belt 91 in this embodiment is described further. Referring to FIG. 7, in this embodiment, the intermediary transfer belt 91 has a base layer and a surface layer. By the way, the intermediary transfer belt 91 may be provided with other layers than the base and surface layer. For example, it may be provided with an intermediary layer. That is, it may be provided with multiple layers which include the base layer and surface layer. As will be described later, the surface layer contains binder resin, fine particles of perfluoropolymer, fluorinated resin dispersant, and fluorine compound. The surface of fine particles of perfluoropolymer is coated with fluorine compound, which is desired to be a perfluoropolyether compound, or a branched polymer compound having a perfluoroalxyl group.

To begin with, the base layer of the intermediary transfer belt 91 is described. As a typical belt usable as the base layer for the intermediary transfer belt 91, it is possible to use a semiconductive belt formed of a mixture of resin and a conductive agent. As the resin to be used as the material for the base layer, it is possible to use either thermosetting or thermoplastic resin. Typically, polyimide, polyamideimide, polyetheretherketone, polyphenylenesulfide, or polyester is used from the standpoint of strength and durability. These resins may be used alone or in mixture (blend or alloy). A selection should be made according to properties, for example, mechanical strength, of which the intermediary transfer belt 91 is required.

As the conduction agent, it is possible to use an electron-conduction substance, or, an ion-conduction substance. As examples of the former, there are carbon black, tin oxide doped with antimony, titanium oxide, or conductive polymer. As the latter, sodium perchlorate, lithium, cationic surfactant, anionic surfactant, non-ionic surfactant, oligomer having oxyalkylene recurring units, or polymer compound is usable.

The base layer is desired to be no less than $1.0\times10^{7}\Omega$ and no more than $1.0\times10^{12}\Omega$, in volume resistivity. Further, it is desired to be no less than $1.0\times10^{8}\Omega/\square$ and no more than $1.0\times10^{14}\Omega/\square$, in surface resistivity. By keeping the volume resistivity of the base layer in the abovementioned range, it is possible to further reduce the image forming apparatus 100 in the amount of image defect attributable to charge up and/or insufficiency in transfer bias, which sometimes occur as the image forming apparatus 100 is continuously driven for a substantial length of time. Further, by keeping the surface resistivity of the base layer within the abovementioned range, it is possible to further reduce the image forming apparatus 100 in the amount of the image defect attributable to the electrical discharge which occurs as a sheet S of transfer medium is separated from the intermediary transfer belt 91. The above-described properties are also required of the electrical resistance of an electrophotographic photosensitive member made up of a base layer, and a surface layer formed on the base layer. Therefore, it is desired that the surface layer of an electrophotographic member is also semiconductive. That is, it is desired that the surface layer contains semiconductive agent for adjusting the surface layer in volume resistivity and surface resistivity. As for the conduction agent for the surface layer, those used for the base layer can be used.

In a case where thermosetting resin such as polyimide is used as the material for the base layer, the base layer (belt) can be formed with the use of the following method: First, varnish is made by dispersing carbon black, as conduction agent, along with solvent, into polyimide precursor or dissolvable polyimide. Then, the varnish is coated on a belt molded with the use of a centrifugal molding machine. Then, the thus formed seamless belt is sintered to yield the base layer for the intermediary transfer belt 91. In a case where a belt formed through the above-described process is used as a transfer belt or an intermediary transfer belt, it is desired that the belt thickness is no less than 30 μm and no more than 150 μm.

Further, when the material for the base layer is thermoplastic resin, the belt can be formed in the following manner: First, carbon black, which is conduction agent, resin, and additives, if necessary, are mixed. Then, semiconductive pellets are formed by mixing the mixture with the use of a kneading-mixing means such as a double axle kneading-mixing machine. Then, resultant pellets of resinous compound are melted and extruded into a sheet of film or a seamless (endless) belt. Further, the base layer can be molded with the use of a thermal pressing machine, an injection molding machine, or the like.

Next, the surface layer of the intermediary transfer belt 91 is described. In this embodiment, the surface layer contains binder resin, fine particles of perfluoropolymer, fluorine resin dispersing agent; and fluorine compound. Also in this embodiment, the surface of fine particles of perfluoropolymer bears fluorine compound, which is perfluoropolyether compound, or branched polymer compound having a perfluoroalkyl group.

As the material for the binder resin, styrene resin, acrylic resin, methacrylic resin, epoxy resin, polyester resin, polyether resin, silicone resin, and polyvinyl-butyral resin, or a mixture of preceding substances, can be used. In particular, methacrylic resin or acrylic resin (which hereafter are collectively referred to as acrylic resin) is preferable, because the fine particles of perfluoropolymer, fluorinated resin dispersant, and fluorine compound, which are the ingredients of the surface layer of the intermediary transfer belt 91, can be desirably dispersed in the acrylic resin by wet-processing.

More concretely, it is possible to form the surface layer in the following manner. Solvent, fine particles of perfluoropolymer, fluorinated resin dispersant, and fluorine compound are uniformly dispersed in polymerizable monomer for forming acrylic resin, with the use of a wet dispersing apparatus. Then, the resultant liquid is coated on the base layer by a method such as bar coating or spray coating. Then, the solvent was removed by drying. Then, the monomers in the resultant layer are made to polymerize by a hardening (curing) method which uses heat (thermal curing method), a beam of electron, or ultraviolet ray, to yield the surface layer. During this process, the polymerization initiator for carrying out the polymerization may be used as necessary. Also, known additives such as the abovementioned conduction agent, oxidization prevention agent, leveling agent, cross-linking agent, and flame retardant may be added as necessary. The thickness of the surface layer is preferably no less than 1 μm, in consideration of the resistance to abrasion and wear attributable to friction which occurs during the normal usage. Further, in consideration of the pliability of the belt when the belt is in the state of suspension, the thickness of the surface layer is desired to be no more than 10 μm. By controlling the condition (solid component density, film formation speed, etc.) under which the surface layer of the intermediary transfer belt 91 is formed, it is possible to form a surface layer having a desirable thickness.

As the polymerizable monomer for forming acrylic resin, such acrylate as pentaerythritol triacrylate, pentaerythritol tetraacrylate, ditrimethylolpropane tetraacrylate, dipentaerythritol hexaacrylate, alkyl acrylate, benzyl acrylate, phenyl acrylate, ethylene glycol diacrylate, acrylates of bisphenol A diacrylate, as well as, such methacrylate as pentaerythritol trimethacrylate, pentaerythritol tetramethacrylate, ditrimethyrol propane tetramethacrylate, dipentaerythritol hexamethacrylate, alkyl methacrylate, benzyl methacrylate, phenyl methacrylate, ethyleneglycol trimethacrylate, bisphenol A dimethacrylate, can be used. Further, it is possible to use oligomers such as urethane acrylate oligomer and epoxy acrylate, which have reactive groups which are no less than 1,000 in molecular weight. Moreover, it is possible to use such acrylate as those which are sold as paint.

As fine particles of perfluoropolymer, it is possible to use fine particles of polytetrafluoroethylene resin (PTFE), or fine particles of copolymer of tetrafluoroethylene and perfluoroalkylvinylether. As commercially available products of fine particles of perfluoropolymer, it is possible to list Lubron L-2, L-5 (products of Daikin Industries Ltd.), MP1100 and MP1200 (products of Du Pont Mitsui Fluorochemicals Ltd.), Fluon L150J and L155J (products of Asahi Glass Co., Ltd.), and SST 3 (product of shamrock Technology Inc.). The perfluoropolymer particles are preferably as small as possible. More concretely, they are desired to be no less than 5 nm and no more than 1 μm in average diameter.

In this embodiment, fluorine compound dispersant was used to uniformly disperse fine particles of perfluoropolymer in binder resin. Fluorine compound dispersant is desired to have such portions that have affinity to both perfluoroalxyl chain and hydrocarbon. That is, it is desired to have both affinity and aversion to fluorine. More specifically, surfactants, amphiphilic block copolymers, and amphiphilic graft polymer can be named. Among them, (i) vinyl monomer having fluoroalkyl group, acrylate or a block copolymer obtainable by copolymerizing acrylate or methacrylate having, (ii) comb graft copolymer obtainable by copolymerizing acrylate or methacrylate having fluoroalkyl group, and methacrylate macromonomer having a methacrylate in the side chain, are preferable. As examples of the abovementioned (i) block copolymer, MODIPER F200, F210, F2020, F600, FT-600 (products of NOF Corporation) are available. As examples of the abovementioned (ii) comb-shaped graft copolymer, Aaron GF-150, GF-300, and GF-400 (products of Toa Gosei Co., Ltd.) which is fluorine graft polymer, are available.

In this embodiment, fluorine compounds are perfluoropolyether compound (which hereafter will be referred to as PFPE), or branched polymer compound having perfluoroalkyl group. Perfluoropolyether compound is a collective name for oligomer, or polymer, having perfluoroalxylene-ether as recurring units. More concretely, perfluoromethylene-ether, perfluoroethylene-ether, and perfluoropropylene-ether can be named. In this embodiment, any of these perfluoropolyether compounds is usable.

Given next is a concrete list of usable PFPEs. As PFPE, oily polymer has been known as fluorine oil. More concretely, DEMNUM (product of Daikin Industries Co. Ltd), Krytox (product of DuPont), and Fonburin (product of Solvay Solexis) are usable, for example. Among them, those having affinity to the binder resin and fluoropolymer particles in the surface layer of the intermediary transfer belt 91 are preferable. More concretely, Fluorolink MD500, MD700, 5101X, 5113X, AD1700, and Fomblin MD40 (product of Solvay Solexis Co., Ltd.) which are PFPE, the end of which is an alkyl unit having no fluorine, OPTOOL DAC-HP (product of Daikin Industries Co., Ltd), and KY164 and KY108 (product of Shinetsu Chemical Industry Co., Ltd.) can be listed. As for PFPE which does not contain alkyl group, there can be listed Fluorolink S10 (product of Solvay Solexis Co. Ltd.), OPTOOL DAC DSX (product of Daikin Industries Co., Ltd.), and KY164 and KY108 (products of Shinetsu Chemical Co., Ltd.), which have silyl group.

Next, branched polymer compound having perfluoroalkyl group is described. As branched polymer compounds having perfluoroalkyl group, those which are affinitive to the binder resin and perfluoropolymer fine particles in the surface layer are preferable. More concretely, (a) branched polymer compounds having trifluoromethyl group, such as HYPER TECH FA-200, FA-E-50, FX-012 (products of Nissan Chemical Industries Co., Ltd.) which are water-repellent and oil-repellent fluorine oils having hyper-branch structure, and FTERGENT 600A and 601A (product of Neos Co., Ltd.) which are water-repellent and oil repellent fluorine oil containing hexafluoropropane oligomer; and (b) branched polymer compound having tridecafluorohexane group, such as Megafac F-552, F-555, F-558, RS-72-K, RS-75, can be listed.

The amount by which perfluoropolymer fine particles are contained in the surface layer of the intermediary transfer belt 91 is desired to be no less than 10%, preferably, no less than 20%, ideally, no less than 30% relative to the entirety of solid substances which make up the surface layer. Further, from the standpoint of ensuring that the particles are desirably dispersed, the amount is desired to be no more than 80%. As for the amount by which fluorinated resin dispersant is contained in the surface layer, it is desired to be no less than 1% and no more than 10% relative to the entirety of the solid substances which make up the surface layer. Further, the amount by which branched polymer compound having PFPE and perfluoroalkyl group is contained in the surface layer is desired to be no less than 1.0% and no more than 5.0%, preferably, no less than 0.3% and no more than 3.0%, relative to the entirety of the solid substances which make up the surface layer, because it is reasonable to think that the amount is related to a mechanism similar to the mechanism through which surfactant or the like forms a monomolecule layer as the outermost layer. Further, in consideration of the fact that the branched polymer compound having PFPE and perfluoroalkyl group is borne by the perfluoropolymer fine particle in the desirably wet condition, the amount by which the branched polymer compound having PFPE and perfluoroalkyl group is contained in the surface layer is desired to be no more than ⅕, preferably, no more than 1/10, relative to the perfluoropolymer fine particles.

Further, the surface roughness Rz (which will be described later) of the surface layer of the intermediary transfer belt 91 in this embodiment when the intermediary transfer belt 91 is brand-new is 0.05.

3. Control Sequence

Figure 3:
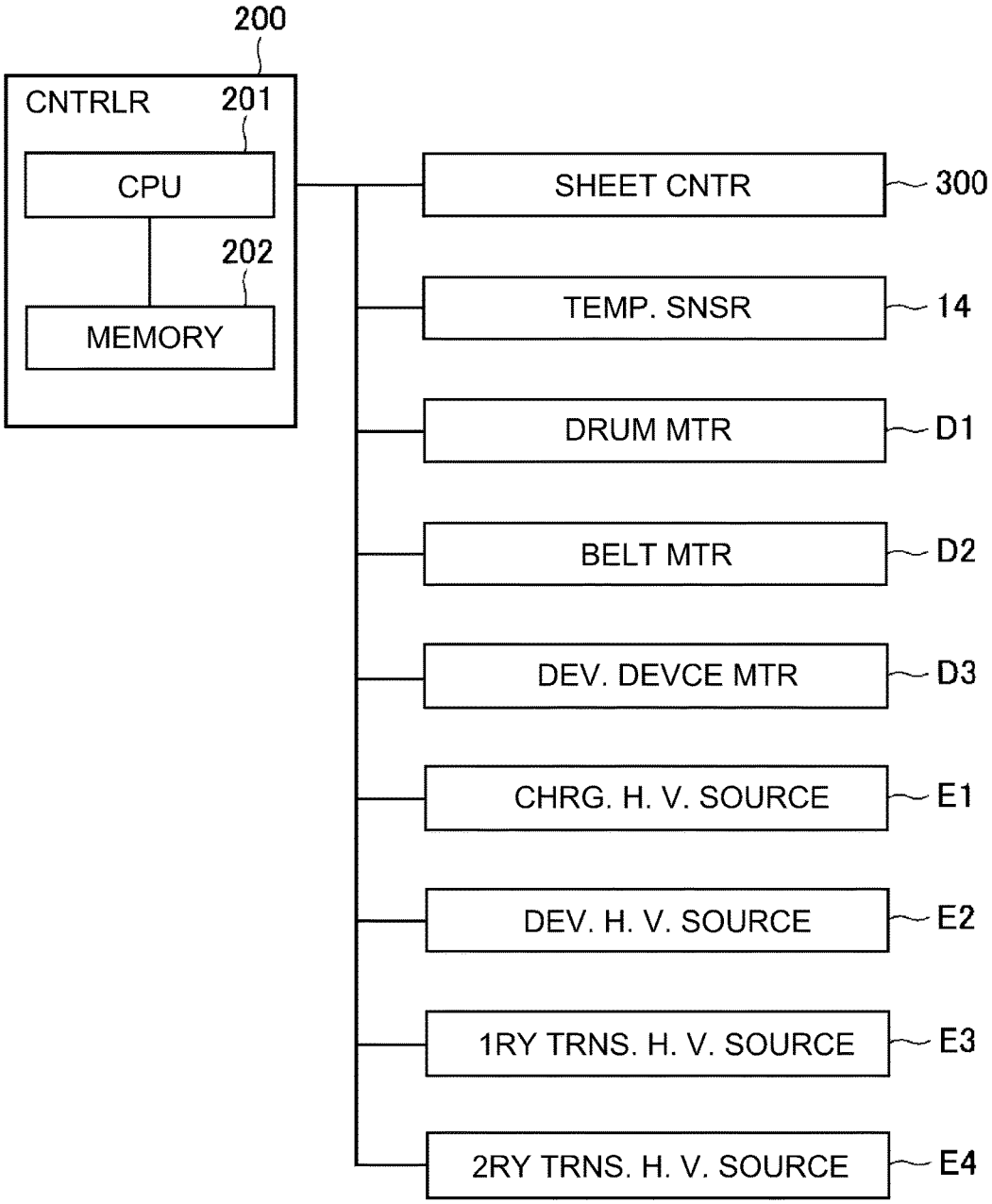
FIG. 3 is a block diagram of the toner supply sequence of the image forming apparatus, which shows how the image forming apparatus is controlled during the toner supply sequence.

FIG. 3 is a block diagram of a part of control sequences of the image forming apparatus 100 in this embodiment. In this embodiment, the control portion 200 with which the main assembly of the image forming apparatus 100 is provided integrally controls the image forming apparatus 100. The control portion 200 has a CPU 201 as a computing portion, and a memory 202 as a storage portion. The CPU 201 controls operations of various portions of the image forming apparatus 100, according to programs and data stored in the memory 202. More concretely, the control portion 200 controls: the driving of the photosensitive drum 1, developing device 4, and intermediary transfer belt 91; voltage application by high voltage charging power source E1, high voltage developing power source E2, high voltage transferring power source E3, and high voltage secondary transfer power source E4; toner supply sequence, which will be described later; and the like.

Further, in this embodiment, the image forming apparatus 100 has a sheet counter 300 as a counting means for counting the number of sheets S of transfer medium discharged from the image forming apparatus 100 after a toner image is fixed to the sheet S. The sheet counter 300 is an example of a detecting means for detecting the value of the index related to the cumulative length of usage of the intermediary transfer belt 91 since the intermediary transfer belt 91 was brand-new. In this embodiment, the sheet counter 300 obtains the cumulative number (which hereafter will be referred to as cumulative sheet count N1) of sheets outputted from the image forming apparatus 100, and the cumulative number (which hereafter will be referred to as toner supply interval sheet count N2) of sheets outputted from the image forming apparatus 100 between two consecutive carried out toner supply sequences. The cumulative sheet count N1 and toner supply interval sheet count N2 which will be described later. Further, in this embodiment, the image forming apparatus 100 has a temperature sensor 14, as an ambience detecting means, which detects the ambience (internal and external temperatures of image forming apparatus 100, or at least one of them). Thus, the internal temperature T of the image forming apparatus 100 can be monitored.

The cumulative sheet count N1 and toner supply interval sheet count N2, obtained by the sheet counter 300, and the ambient temperature T detected by the temperature sensor 14, etc., are stored in the memory 202. The memory 202 is an example of storing means for storing the information related to the cumulative amount by which an intermediary transferring member was used since it was brand-new. Further, the control portion 200 controls the toner supply sequence, which will be described later, based on the cumulative sheet count N1 stored in the memory, toner supply interval sheet count N2, and ambient temperature T. Here, the cumulative sheet count N1 is reset each time the intermediary transfer belt 91 in the image forming apparatus 100 is replaced with a brand-new one. The toner supply interval sheet count N2 is reset each time the toner supply sequence, which will be described later, is carried out. By the way, the sheet counter 300 may be such that its output is equivalent to the number of sheets of a specific size.

The image forming apparatus 100 carries out an image outputting sequence (job, printing operation) for forming an image on a single, or multiple, sheets S of transfer medium, and outputting the sheet S or sheets S, which are initiated by an image formation start command. Generally speaking, each job has an image formation process, a pre-rotation process, sheet intervals (which occur only when images are formed on two or more sheets), and a post-rotation process. The image formation process is related to a period in which an electrostatic latent image of an image to be formed is actually formed on a sheet S of transfer medium; a toner image is formed; the toner image is transferred onto the intermediary transfer belt 91; and the toner image is transferred onto the sheet S. That is, an image formation period refers to this period. More precisely, these periods, that is, the electrostatic latent image formation period, toner image formation period, primary transfer period, and secondary transfer period, are different in position and timing. The pre-rotation process corresponds to the period from when a start command is inputted to when an image begins to be actually formed, that is, a preparatory period for the image formation process. The sheet interval corresponds to the periods which occur when the image formation process is continuously carried out for two or more sheets S of transfer medium (continuous image formation). That is, it is the period between two sequentially conveyed sheets S of transfer medium. The post-rotation process corresponds to the period which comes after the completion of the image formation process. That is, it corresponds to a period (preparatory period) in which the image forming apparatus 100 is cleaned up after the completion of the image formation process. An idling period refers to any period other than the image formation period. It includes the abovementioned pre-rotation process, sheet interval, post-rotation process, as well as the multiple pre-rotation process which corresponds to a preparatory operation which is carried out as the main power source of the image forming apparatus 100 is turned on, or when the image forming apparatus 100 recovers from the sleeping state. That is, the sheet interval corresponds to the idling period which occurs between the consecutively conveyed two sheets S or transfer medium, in an image formation sequence for forming images on two or more sheets S of transfer medium. The post-rotation period corresponds to the idling period which occurs after the last image is outputted in an image formation sequence in which an image is formed on a single, or two or more sheets S of transfer medium.

4. Mechanism of Occurrence of Image Defect in the Form of Unwanted Horizontal Stripe In a case where a combination of the intermediary transfer belt 91 and cleaning blade 11*a* in this embodiment is in use by an image forming apparatus, it occurs sometimes after the apparatus is used to output no less than a preset number of images, is left unattended for a certain length of time, and is reused for image formation, that the apparatus outputs defective images, more specifically, images which suffer from unwanted stripes (parallel to primary scan direction). The earnest studies of this phenomenon by the inventors of the present invention led to a conclusion that it is reasonable to think that the occurrence of these unwanted stripes (image defects) is attributable to the following mechanism.

First, referring to part (a) of FIG. 4, some ingredients of the surface layer of the intermediary transfer belt 91 become active and ooze out onto the surface of the intermediary transfer belt 91, in particular, when the ambient temperature is high. Next, referring to part (b) of FIG. 4, the ingredients having oozed out (which hereafter may be referred to simply as "oozed ingredients") are scraped away from the surface of the intermediary transfer belt 91 by the cleaning blade 11*a*, and collect along the cleaning edge of the cleaning blade 11*a*. If the "oozed ingredients" having collected along the cleaning edge of the cleaning blade 11*a* are left unattended for a certain length of time, they solidly adhere to the surface of the intermediary transfer belt 91, as shown in part (c) of FIG. 4, making it impossible for the cleaning blade 11*a* to scrape them away. Thus, as the image forming apparatus 100 is restarted for the next image formation, the oozed ingredients having solidly adhered to the intermediary transfer belt 91 move past a cleaning portion CL which is the area of contact between the cleaning blade 11*a* and intermediary transfer belt 91. That is, the ingredients having oozed out of the surface layer of the intermediary transfer belt 91 and solidly adhered to the surface reach the primary transferring portion T1 (area of contact) between the photosensitive drum 1 and intermediary transfer belt 91, as shown in Figures (d) and (e), in the next image forming operation. Consequently, the image forming apparatus 100 outputs images having an image defect which is in the form of horizontal stripes which correspond in position to the portion of the intermediary transfer belt 91 having the solidified oozed ingredients, as shown in part (f) of FIG. 4.

5. Relationship Between Image Defect in the Form of Unwanted Horizontal Stripe and Temperature As the temperature of the intermediary transfer belt 91 increases due to the increase in the ambient temperature of the intermediary transfer belt 91 as described above, some ingredients in the surface layer of the intermediary transfer belt 91 become active. As they become active, they are likely to ooze out onto the surface of the surface layer, and therefore, are likely to cause the image forming apparatus 100 to output images having unwanted horizontal stripe (image defect). Table 1 shows the results of the studies made to find out the relationship between the ambient temperature T and whether or not the unwanted horizontal stripe (image defect) occurs. Presence or absence of the image defect was confirmed with the use of the same method (different in temperature, however) as the method used to obtain the results shown in Table 2, which will be described later. In these tables, "G" indicates that the image defect did not occur, and "N" indicates that the image defect occurred.

TABLE 1

| Ambient Temp. (° C.) | Image Defect Prevention |
|---|---|
| 10 | G |
| 15 | G |
| 20 | G |
| 23 | G |
| 25 | N |
| 27 | N |
| 30 | N |
| 35 | N |

6. Relationship Among Image Defect in the Form of Unwanted Horizontal Stripe, Surface Roughness of Intermediary Transfer Belt, and Cumulative Sheet Count N1

Table 2 shows the results of the studies made to examine the relationship among the image defect (unwanted horizontal stripe), surface roughness of intermediary transfer belt, and cumulative sheet count N1. In the studies, the same intermediary transfer belt 91 (0.05 in surface roughness when new) was used to continuously output black images which were 5% in print ratio (image ratio) by the above-described image forming apparatus 100, while confirming the presence or absence of the image defect every preset cumulative sheet count N1, with the use a method which will be described later. Here, the surface roughness Rz was measured with the use of a surface roughness gauge SE3500 (product of Kosaka Laboratory Co., Ltd.).

The presence or absence of the image defect was confirmed using the following method: First, 500 prints were outputted by the above-described image forming apparatus 100, with the use of sheets of paper of size A4. Then, the image forming apparatus 100 was left unattended for an hour. Then, five solid black (Bk) images were outputted on five sheets of paper of size A3, one for one, by the same image forming apparatus 100. Here, "G" indicates that the image defect did not occur, and "N" indicates that the image defect occurred.

It is evident from Table 2 that there is correlation among the occurrence of image defect (unwanted horizontal stripe), surface roughness Rz of the intermediary transfer belt 91, and cumulative sheet count N1, and also, that if the surface roughness Rz is no less than a preset threshold value, the image defects do not occur. These results are thought to be attributable to the following reason. That is, as the cumulative sheet count N1 increases in value, the intermediary transfer belt 91 increases in surface roughness Rz due to the friction which occurs between the intermediary transfer belt 91 and cleaning blade 11*a*, in the area of contact between the intermediary transfer belt 91 and cleaning blade 11*a*, and the friction which occurs between the intermediary transfer belt 91 and toner, in the area of contact between the intermediary transfer belt 91 and photosensitive drum 1. In a case where the surface roughness Rz of the intermediary transfer belt 91 is greater than a certain value, it is easier for the "oozed ingredients" to slip through the cleaning portion CL (that is, it is difficult for "oozed ingredients" from being scraped up).

In the case of the image forming apparatus 100 in this embodiment, the relationship between the cumulative sheet count N1 and the surface roughness Rz of the intermediary transfer belt 91 that as the cumulative sheet count N1 increases in value, the intermediary transfer belt 91 increases in surface roughness Rz always remains the same in practical terms. Therefore, it is possible to estimate the surface roughness Rz of the intermediary transfer belt 91 and the likelihood of occurrence of the image defect, based on the cumulative sheet count N1.

TABLE 2

| Cumulated Prints | Rz (μm) | Image Defect Prevention |
|---|---|---|
| 0 | 0.05 | N |
| 5000 | 0.12 | N |
| 10000 | 0.15 | N |
| 20000 | 0.18 | N |
| 30000 | 0.20 | N |
| 40000 | 0.24 | N |
| 50000 | 0.26 | G |
| 60000 | 0.31 | G |
| 70000 | 0.35 | G |
| 100000 | 0.55 | G |

7. Relationship Between Image Defect in the Form of Unwanted Horizontal Stripe and Toner Supply Sequence (Toner Supplying Operation)

In the case of the image forming apparatus 100 in this embodiment, a toner supply sequence is carried out with preset frequency, in which a rectangular solid black (Bk) toner image, which is 50 mm long in terms of the direction parallel to the circumferential direction of the intermediary transfer belt 91, is formed, and is supplied to the cleaning portion CL (it is not transferred onto sheet S of transfer medium). By the way, in this embodiment, a preset toner image (supply toner image) formed in a toner supplying operation has such a length, in terms of the lengthwise direction of the photosensitive drum 1 (widthwise direction of intermediary transfer belt 91), that reaches from one end of the image formation area (which can bear toner image) to the other. That is, in this embodiment, the supply toner image is a rectangular image which extends in the widthwise direction of the intermediary transfer belt 91. Thus, the supply toner image can supply the cleaning blade 11*a* with toner across roughly the entirety of the cleaning edge of the cleaning blade 11*a* in terms of the lengthwise direction of the cleaning blade 11*a*.

Table 3 shows the results of the studies in which it was checked whether or not image defect in the form of an unwanted horizontal stripe occurred, while changing the image forming apparatus 100 in the frequency with which the toner supply sequence was carried out. Whether or not the image defect occurred was confirmed with the use of the same method as the one used to obtain the results shown in Table 2. Here, "G" indicates that the image defect did not occur, and "N" indicates that the image defect occurred.

It is evident from Table 3 that the greater the frequency with which the toner supply sequence is carried out, that is, the greater the amount by which the cleaning portion CL is supplied with toner, the less likely it is for the image defect to occur, for the following reason. That is, it is thought that as the cleaning portion CL is supplied with toner, the toner and external additives mix with the "oozed ingredients", making it less likely for the oozed ingredients to solidly adhere to the intermediary transfer belt 91.

It is also evident from Table 3 that as the cumulative sheet count N1 increases, that is, as the intermediary transfer belt 91 increases in surface roughness Rz, the amount by which toner has to be supplied to the cleaning portion CL to prevent the occurrence of the image defect reduces. This phenomenon is thought to have occurred because as the cumulative sheet count N1 increased, the intermediary transfer belt 91 increased in surface roughness Rz as described above, and therefore, it became easier for the oozed ingredients to slip through the cleaning portion CL (less likely to be scraped up by cleaning blade 11*a*), reducing thereby the amount by which the cleaning portion CL needs to be supplied with toner.

TABLE 3

| | | Freq. of toner supplies (times/prints) | | | | | |
|---|---|---|---|---|---|---|---|
| | | 1/10 | 1/25 | 1/50 | 1/100 | 1/150 | No |
| Cumulated Prints | 0 | G | G | N | N | N | N |
| | 5000 | G | G | G | N | N | N |
| | 10000 | G | G | G | N | N | N |
| | 20000 | G | G | G | G | N | N |
| | 30000 | G | G | G | G | N | N |
| | 40000 | G | G | G | G | G | N |
| | 50000 | G | G | G | G | G | G |

8. Relationship Between Cleaning Blade Buckling and Toner Supply Sequence

One of the causes of the occurrence of the buckling of the cleaning blade 11*a* (which hereafter may be referred to simply as "blade buckling") is that the cleaning edge of the cleaning blade 11*a* runs short of lubricants such as toner and external additives. Thus, as a means to prevent the blade buckling, it is effective to periodically supply the cleaning portion CL with toner.

Table 4 shows the results of the tests in which whether or not the blade buckling occurred was checked while 100,000 solid images were outputted with the use of the above-described image forming apparatus 100 fitted with the intermediary transfer belt 91, in an ambience which was 15° C. in temperature, and an ambience which was 30° C. in temperature, and which were different in the frequency with which the toner supply sequence was carried out. The intermediary transfer belt 91 was 0.05 μm in surface roughness Rz when it was new. "G" indicates that the blade buckling did not occur, and "N" indicates that the blade buckling occurred.

The blade buckling occurred in a case where the frequency with which toner supply sequence is to be carried out was set to no more than once every 300th sheet, whether the ambient temperature was 15° C. or 30° C., as shown in Table 4.

TABLE 4

| Toner supply Frequency (times/prints) | Blade Curling-Down Prevention |
|---|---|
| 1/100 | G |
| 1/200 | G |
| 1/300 | N |
| 1/400 | N |

TABLE 4-continued

| Toner supply Frequency (times/prints) | Blade Curling-Down Prevention |
|---|---|
| 1/500 | N |
| No | N |

9. Toner Supply Sequence in this Embodiment

In this embodiment, the frequency X with which the toner supply sequence is to be carried out (which hereafter may be referred to simply as "toner supply frequency X") is set according to the cumulative sheet count N1 and ambient temperature T, with reference to Table 5 stored in the memory 202. The CPU 201 forms, with the set frequency, on the intermediary transfer belt 91, a solid black (Bk) rectangular image which is 50 mm in dimension in terms of the circumferential direction of the intermediary transfer belt 91 (and which covers from one edge of intermediary transfer belt 91 to other), and supplies cleaning portion CL with the solid black toner image, that is, without transferring the image to a sheet S of transfer medium. Therefore, it is possible to prevent the blade buckling for a long period of time, and therefore, it is possible to prevent the occurrence of the image defect which is in the form of a horizontal stripe.

That is, referring to Table 1, when the ambient temperature T is no less than 25° C., the image defect (unwanted horizontal strip) does not occur. Therefore, it is unnecessary to carry out the toner supply sequence to prevent the occurrence of the image defect in the form of an unwanted horizontal stripe. However, if the toner supply sequence is not carried out at all, it is possible that the blade buckling will occur as shown in Table 4. Therefore, in order to prevent the blade buckling, the toner supply sequence is always carried out at a frequency of once every 200th sheet regardless of the value of the cumulative sheet count N1.

On the other hand, when the ambient temperature is no less than 25° C., it is possible that the image defect in the form of an unwanted horizontal stripe will occur, as shown in Table 1. Therefore, the toner supply sequence needs to be carried out to prevent the occurrence of the image defect in the form of an unwanted horizontal stripe. Referring to Table 3, the minimum frequency with which the toner supply sequence needs to be carried out to prevent the occurrence of the image defect in the form of an unwanted horizontal stripe is affected by the cumulative sheet count N1. Therefore, as the cumulative sheet count N1 increases, the toner supply frequency X is to be reduced as shown in Table 5. By the way, when the cumulative sheet count N1 is no less than 50,000, the image defect in the form of an unwanted horizontal stripe does not occur even if the toner supply sequence is not carried out, as shown in Table 3. Yet, in this embodiment, as the cumulative sheet count N1 increased beyond 50,000, the toner supply sequence was carried out at a frequency of once every 200th sheet, as shown in Table 5, in order to prevent the occurrence of the blade buckling.

Here, it is reasonable to think that if the toner supply sequence is always carried out at a toner supply frequency X of once every 25th sheet, regardless of the ambient temperature T and cumulative sheet count N1, it is possible to prevent the occurrence of the blade buckling and image defect in the form of an unwanted horizontal stripe. This, however, increases downtime and toner consumption, and therefore, is undesirable.

TABLE 5

| Cumulated Prints | Toner supply Frequency X | |
|---|---|---|
| | Amb. T < 25° C. | 25° C. ≤ Amb.T |
| 0 ≤ N1 < 5000 | 1/200 | 1/25 |
| 5000 ≤ N1 < 20000 | 1/200 | 1/50 |
| 20000 ≤ N1 < 40000 | 1/200 | 1/100 |
| 40000 ≤ N1 < 50000 | 1/200 | 1/150 |
| 50000 ≤ N1 | 1/200 | 1/200 |

10. Control Flow

Next, referring to FIG. 5, the control flow of the toner supply sequence in this embodiment is described.

As a job is inputted (S101), the CPU 201 reads the ambient temperature T and cumulative sheet count N1 (S102). Then, CPU 201 sets the toner supply frequency X according to the read ambient temperature T and cumulative sheet count N1, with reference to Table 5 (S103). Then, it makes the image forming apparatus 100 start image formation (S104). While the job is carried out, the CPU 201 checks whether or not the toner supply interval sheet count N2 is no less than toner supply frequency X (S105). If it determines in S105 that the toner supply interval sheet count N2 is no less than the toner supply frequency X ("Yes"), it interrupts the image formation (S106), and makes the image forming apparatus 100 carry out the above-described toner supply sequence (S107). Then, it resets the toner supply interval sheet count N2 to zero (S108), and makes the image forming apparatus 100 restart the interrupted image formation (S109). Then, it checks whether or not job has been completed (S110). If the CPU 201 determines in S110 that the job has been completed ("Yes"), it ends the flow. If it determines that the job has not been completed ("No"), it returns to S105. Further, if it determines in S105 that the toner supply interval sheet count N2 is no more than the toner supply frequency X ("No"), it proceeds to S110 without interrupting the image formation.

In this embodiment, by carrying out the toner supply sequence following the flowchart given in FIG. 5, it is possible to continuously prevent the occurrence of the blade buckling and image defect in the form of an unwanted horizontal stripe. Therefore, it is possible to continuously output desirable images for a long period of time. Further by not carrying out the toner supply sequence with excessive frequency, it is possible to prevent the toner consumption and downtime from significantly increasing.

As described above, in this embodiment, the image forming apparatus 100 has the control portion 200 which makes the image forming apparatus 100 carry out the toner supply sequence which is to be carried out during an idling period to transfer a prescribed toner image onto the intermediary transfer belt 91 to supply the cleaning portion CL with this prescribed toner image. The control portion 200 adjusts the amount by which toner is to be supplied to the cleaning portion CL per preset period by the toner supply sequence, based on the cumulative sheet count N1 stored in the memory 202, and the results of detection by the temperature sensor 14. In particular, in this embodiment, the control portion 200 changes the frequency with which it makes the image forming apparatus 100 carry out the toner supply sequence, based on the cumulative sheet count N1 stored in the memory 202 and the results of the detection by the temperature sensor 14. Referring to Table 5, in this embodiment, the control portion 200 makes less, the frequency with which it makes the image forming apparatus 100 carry out the toner supply sequence when the cumulative sheet count N1 (index value related to amount of usage) has the second value than when the cumulative sheet count N1 has the first value. Further, the control portion 200 makes greater, the frequency with which it makes the image forming apparatus 100 carry out the toner supply sequence when the ambient temperature has the second value than when the ambient temperature has the first value. Referring again to Table 5, in this embodiment, when the ambient temperature is no higher than a preset value, the control portion 200 keeps stable at a preset value, the frequency with which it makes the image forming apparatus 100 carry out the toner supply sequence, regardless of the cumulative sheet count N1. Further, when the cumulative sheet count N1 is no less than a preset value, the control portion 200 keeps at a preset value, the frequency with which it makes the image forming apparatus 100 carry out the toner supply sequence, regardless of the ambient temperature and cumulative sheet count N1.

As described above, according to this embodiment, it is possible to prevent the occurrence of the image defect in the form of an unwanted horizontal stripe which occurs in a case where an intermediary transfer belt, the coated surface layer of which contains fluorine compound, is used, without significantly increasing toner consumption and downtime.

Embodiment 2

Next, another embodiment of the present invention is described. The image forming apparatus in this embodiment is the same in basic structure and operation as the image forming apparatus 100 in the first embodiment. Thus, the elements of the image forming apparatus in this embodiment, which are the same as, or correspondent to, the counterparts in the image forming apparatus 100 in the first embodiment, are given the same referential codes, one for one, and are not described in detail.

In this embodiment, the image forming apparatus is enabled to carry out two types of toner supply sequence, that is, a sheet interval toner supply sequence, which is to be carried out during one of the sheet intervals in a job, like the one in the first embodiment, and a post-rotation toner supply sequence which is to be carried out during the post-rotation period which occurs immediately after the completion of a job.

1. Relationship Between Image Defect in the Form of an Unwanted Horizontal Stripe and Toner Supply Timing As a result of earnest studies made by the inventors of the present invention, it became evident that setting the timing with which toner is to be supplied to the cleaning portion CL through the toner supply sequence, to immediately before the intermediary transfer belt 91 is stopped, is effective to prevent the occurrence of the image defect in the form of an unwanted horizontal stripe. That is, it is reasonable to think that the image defect in the form of an unwanted horizontal stripe is caused by the phenomenon that the ingredients having oozed out of the surface layer of the intermediary transfer belt 19 solidly adhere to the intermediary transfer belt 91 when the intermediary transfer belt 91 is not moving, as described above. Thus, in a case where the toner supply sequence is carried out during a job, the ingredients which ooze out of the surface layer of the intermediary transfer belt 91 after the completion of the toner supply sequence continue to accumulate in the cleaning portion CL until the intermediary transfer belt 91 is stopped.

In this embodiment, therefore, the toner supply sequence is carried out during the period between when the job is completed and when the intermediary transfer belt 91 is stopped. Therefore, it is possible to effectively reduce the amount by which the "oozed ingredients" accumulate in the cleaning portion CL before the intermediary transfer belt 91 is stopped.

2. Toner Supply Sequence in this Embodiment

In this embodiment, the image forming apparatus is enabled to carry out two types of toner supply sequence, more specifically, the sheet interval toner supply sequence and the post-rotation toner supply sequence, as described above.

In this embodiment, a sheet counter 300 obtains the cumulative sheet count N1, toner supply interval sheet count N2, sheet interval toner supply sheet count N3, and post-rotation toner supply sheet count N4. Like in the first embodiment, the cumulative sheet count N1, toner supply interval sheet count N2, sheet interval toner supply sheet count N3, and post-rotation toner supply sheet count N4 obtained by the sheet counter 300, and ambient temperature T detected by the temperature sensor 14, etc., are stored in the memory 202. In this embodiment, the control portion 200 controls the sheet interval toner supply sequence, post-rotation toner supply sequence, based on the cumulative sheet count N1, toner supply interval sheet count N2, sheet interval toner supply sheet count N3, and post-rotation toner supply sheet count N4 stored in the memory 202. Here, the sheet interval toner supply sheet count N3 and post-rotation toner supply sheet count N4 are such counts that are to be reset each time either the sheet interval toner supply sequence or post-rotation toner supply sequence is carried out, as will be described later.

In this embodiment, CPU 201 sets the sheet interval toner supply frequency X1 and post-rotation toner supply frequency X2, according to the cumulative sheet count N1 and ambient temperature T, with reference to Tables 6 and 7, which are stored in the memory 202. Then, it supplies the cleaning portion CL with a solid black (Bk) rectangular image which is 50 mm in dimension in terms of the moving direction of the intermediary transfer belt 91 (and which extends from one edge of intermediary transfer belt 91 to the other), without transferring the solid black (Bk) image onto a sheet S of transfer medium, with the set sheet interval toner supply frequency X1 and post-rotation toner supply frequency X2.

That is, the sheet interval toner supply sequence and post-rotation toner supply sequence are controlled according to the sheet interval toner supply sheet count N3 and post-rotation toner supply sheet count N4, respectively. In particular, in this embodiment, the toner supply sequence is carried out either when the sheet interval toner supply sheet count N3 becomes no less than the sheet interval toner supply frequency X1 based on Table 6, or the post-rotation toner supply sheet count N4 becomes greater than the post-rotation toner supply frequency X2 based on Table 7. Both the sheet interval toner supply sheet count N3 and post-rotation toner supply sheet count N4 are reset as either the sheet interval toner supply sequence or post-rotation toner supply sequence is carried out.

Referring to Tables 6 and 7, in this embodiment, in a case where the ambient temperature T and cumulative sheet count N1 are within their preset ranges, the frequency with which the post-rotation toner supply sequence is carried out is greater than the frequency with which the sheet interval toner supply sequence is carried out, because supplying the cleaning portion CL with toner immediately before the intermediary transfer belt 91 is stopped is more effective to prevent the occurrence of the image defect in the form of an unwanted horizontal stripe, as described above.

TABLE 6

| Cumulated | Sheet-Sheet Interval Toner supply Frequency X1 | |
|---|---|---|
| Prints | Amb. T < 25° C. | 25° C. ≤ Amb.T |
| 0 ≤ N1 < 5000 | 1/200 | 1/25 |
| 5000 ≤ N1 < 20000 | 1/200 | 1/50 |
| 20000 ≤ N1 < 40000 | 1/200 | 1/100 |
| 40000 ≤ N1 < 50000 | 1/200 | 1/150 |
| 50000 ≤ N1 | 1/200 | 1/200 |

TABLE 7

| Cumulated | Post-rotation Toner supply Frequency X2 | |
|---|---|---|
| Prints | Amb. T < 25° C. | 25° C. ≤ Amb.T |
| 0 ≤ N1 < 5000 | 1/200 | 1/25 |
| 5000 ≤ N1 < 20000 | 1/200 | 1/50 |
| 20000 ≤ N1 < 40000 | 1/200 | 1/100 |
| 40000 ≤ N1 < 50000 | 1/200 | 1/150 |
| 50000 ≤ N1 | 1/200 | 1/200 |

3. Control Flow

Next, referring to FIG. 6, the control flow of the toner supply sequence in this embodiment is described.

As a job is inputted (S201), the CPU 201 reads the ambient temperature T and cumulative sheet count N1 (S202). Then, the CPU 201 sets the sheet interval toner supply frequency X1 and post-rotation toner supply frequency X2 according to the read ambient temperature T and cumulative sheet count N1, with reference to Tables 6 and 7 stored in the memory 202 (S203). Then, it makes the image forming apparatus 100 start image formation (S204). While the job is carried out, the CPU 201 checks whether or not the sheet interval toner supply sheet count N3 is no less than the sheet interval toner supply frequency X1 (S205). If it determines in S205 that the sheet interval toner supply sheet count N3 is no less than the sheet interval toner supply frequency X1 ("Yes"), it interrupts the image formation (S206), and makes the image forming apparatus 100 carry out the above-described toner supply sequence (S207). Then, it resets the post-rotation toner supply sheet count N4 to zero (S208), and makes the image forming apparatus 100 restart the interrupted image formation (S209). Then, it checks whether or not the job has been completed (S210). If it determines in S210 that the job has not been completed ("No"), it returns to S205. On the other hand, if it determines in S210 that the job has been completed ("Yes"), it makes the image forming apparatus 100 carry out the above-described post-rotation toner supply sequence (S212). Thereafter, the CPU 201 resets the sheet interval toner supply sheet count N3 and post-rotation toner supply sheet count N4 to zero (S213), and ends the flow. Further, if it determines in S205 that the sheet interval toner supply sheet count N3 is no more than the sheet interval toner supply frequency X1 ("No"), it proceeds to S210 without interrupting the image formation. Further, if it determines in S211 that the post-rotation toner supply sheet count N4 is no more than the post-rotation toner supply frequency X2 ("No"), it ends the flow.

In this embodiment, by carrying out the toner supply sequence following the flowchart in FIG. 6, it is possible to prevent the occurrence of the blade buckling and image defect in the form of an unwanted horizontal stripe, while further reducing the toner consumption and downtime compared to the first embodiment, for a long period of time. Therefore, it is possible to form desirable images for a long period of time.

[Miscellanies]

In the foregoing, the present invention was described with reference to concrete embodiments of the present invention. However, these embodiments are not intended to limit the present invention in scope.

In the above-described embodiments, the number of images outputted with the use of the intermediary transferring member was used as an index related to the amount of the usage of the intermediary transfer belt since the intermediary transferring member is brand-new. However, the preceding embodiments are not intended to limit the presence invention in scope. For example, the detected surface roughness of the intermediary transferring member may be used as the index. As described above, there is a correlation between the surface roughness of the intermediary transferring member and the amount of the usage of the intermediary transferring member. Further, there is also a correlation between the surface roughness of the intermediary transferring member and the likelihood of the occurrence of the image defect in the form of an unwanted horizontal stripe. Therefore, it is possible to use the surface roughness of the intermediary transferring member, as the index, in place of the cumulative sheet count used in the above-described embodiments. Moreover, in place of the surface roughness of the intermediary transferring member, the glossiness of the intermediary transferring member, which has a correlation to the surface roughness of the intermediary transferring member, may be used. Furthermore, the length of time (number of rotation) the intermediary transferring member has been driven, or the like, may be used.

Further, in the above-described embodiments, the amount by which toner is to be supplied to the cleaning portion was adjusted by the frequency with which the toner is supplied to the cleaning portion. However, the amount by which toner is to be supplied each time may be adjusted by the dimension of the supply toner image in terms of the circumferential direction of the intermediary transferring member, or by the toner density of the supply toner image. If it is wanted to increase the amount by which toner is to be supplied, all that is necessary is to increase the supply toner image in its dimension in terms of the circumferential direction of the intermediary transferring member, or to increase the supply toner image in toner density. That is, all that is necessary is to adjust the amount by which toner is to be supplied to the cleaning portion, based on an index correlated to the amount of usage of the intermediary transferring member, and the results of the detection by the ambience detecting means.

Further, in the above-described embodiments, the ambience detecting means detected the internal temperature of the image forming apparatus. However, it may be the external temperature of the image forming apparatus that the ambience detecting means detects. In such a case, all that is necessary is that the correlation is to be established in advance between the likelihood of occurrence of the image defect in the form of an unwanted horizontal stripe and the external temperature of the image forming apparatus. Further, the preceding embodiments were described with reference to a case where the image defect in the form of an unwanted horizontal stripe is more likely to occur when the ambient temperature is relative high than when the embodiment temperature is relatively low. However, these embodiments are not intended to limit the present invention in scope. That is, in a case where the likelihood of occurrence of the image defect in the form of an unwanted horizontal stripe is affected by the ambient humidity instead of the ambient temperature because of the properties of the intermediary transferring member, the ambient detecting means may be designed to detect the ambient humidity instead of, or in addition to, the ambient temperature. In such a case, all that is necessary is that correlation is to be established in advance between the likelihood of occurrence of the image defect in the form of an unwanted horizontal stripe, and the internal or external temperature and humidity (absolute amount of moisture, for example), or humidity (relative humidity, for example).

The present invention is particularly effective when it is applied to an intermediary transfer member, such as those in the preceding embodiments, which has a surface layer which contains fluorine compounds, and therefore, is likely to cause image defect in the form of unwanted horizontal stripes. However, the present invention is also effective when it is applied to intermediary transfer members, other than those in the preceding embodiments, which possibly suffer from the phenomenon that their ingredients ooze out onto their surface and solidly adhere to the surfaces. Moreover, even if the present invention is applied to a belt from which its ingredients do not ooze out, the same effects as those described above can be expected from the present invention, in a case where residues scraped up by a cleaning member during a job solidly adhere to the belt after the completion of the job.

Further, the intermediary transferring member does not need to be an endless belt. For example, it may be in the form of a drum formed by stretching film around a frame.

According to the present invention, it is possible to prevent the occurrence of the image defect in the form of an unwanted horizontal stripe which is likely to occur when an intermediary transfer belt, the coated surface layer of which contains fluorine compounds, is in use, without significantly increasing toner consumption and downtime.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-171508 filed on Aug. 31, 2015, which is hereby incorporated by reference herein in its entirety.

What is claimed is:

1. An image forming apparatus comprising:

an image forming portion configured to form a toner image;

an intermediary transfer member configured to receive the toner image formed by said image forming portion;

a blade configured to clean said intermediary transfer member by removing residual toner therefrom;

an ambient condition sensor configured to detect an ambient condition of said apparatus;

a memory configured to store information relating to an accumulated use amount of said intermediary transfer member from a fresh state thereof; and a controller configured to execute an operation in a mode in which predetermined toner for cleaning said intermediary transfer member is deposited on said intermediary transfer member in an area corresponding to a region between a preceding recording material and a succeeding recording material during execution of a continuous image forming job for continuously forming the images on the recording materials to supply the predetermined toner to said blade, wherein when the accumulated use amount is less than a first predetermined amount and the ambient condition sensed by said ambient condition sensor is a first condition, said controller sets a permissible number, which is a number of image formations from a previous execution of the operation in the mode to a next execution of the operation in the mode, to a first permissible number, when the accumulated use amount is less than the first predetermined amount and the ambient condition sensed by said ambient condition sensor is a second condition different from the first condition, said controller sets the permissible number to a second permissible number, when the accumulated use amount is less than a second predetermined amount which is greater than the first predetermined amount and the ambient condition sensed by said ambient condition sensor is the second condition, said controller sets the permissible number to a third permissible number, wherein the second permissible number is less than the first permissible number and less than the third permissible number, and wherein the accumulated use amount is calculated with calibration depending on a size of the formed image.

2. An apparatus according to claim 1, wherein said intermediary transfer member includes a parting material dispersed surface layer.

3. An apparatus according to claim 1, wherein the information indicates an accumulated number of sheets on which images are formed, from the fresh state of said intermediary transfer member.

4. An apparatus according to claim 1, wherein a surface layer of said intermediary transfer member comprises a binder resin material, perfluoropolymer fine particles, a fluorinated resin dispersant and a fluorine compound, and the perfluoropolymer fine particles carry the fluorine compound on surfaces thereof, and wherein the fluorine compound is a perfluoropolyether compound or a branched polymer compound having a perfluoroalkyl group.

5. An apparatus according to claim 1, wherein when the accumulated use amount is a third predetermined amount which is greater than the second predetermined amount, said controller sets the permissible number to a constant number irrespective of a result of detection of said ambient condition sensor.

6. An image forming apparatus comprising:

an image forming portion configured to form a toner image;

an intermediary transfer member configured to receive the toner image formed by said image forming portion;

a blade configured to clean said intermediary transfer member by removing residual toner therefrom;

a memory configured to store information relating to an accumulated use amount of said intermediary transfer member from a fresh state thereof; and a controller configured to execute an operation in a mode in which predetermined toner for cleaning said intermediary transfer member is deposited on said intermediary transfer member in an area corresponding to a region between a preceding recording material and a succeeding recording material during execution of a continuous image forming job for continuously forming the images on the recording materials to supply the predetermined toner to said blade, wherein when the accumulated use amount is less than a first predetermined amount, said controller sets a permissible number, which is a number of image formations from a previous execution of the operation in the mode to a next execution of the operation in the mode, to a first permissible number, wherein when the accumulated use amount is less than a second predetermined amount which is greater than the first predetermined amount, said controller sets the permissible number to a second permissible number, wherein the second permissible number is greater than the first permissible number, and wherein the accumulated use amount is calculated with calibration depending on a size of the formed image.

7. An apparatus according to claim 6, wherein said intermediary transfer member includes a parting material dispersed surface layer.

8. An apparatus according to claim 1, wherein the information indicates an accumulated number of sheets on which images are formed, from the fresh state of said intermediary transfer member.

9. An apparatus according to claim 6, wherein a surface layer of said intermediary transfer member comprises a binder resin material, perfluoropolymer fine particles, a fluorinated resin dispersant and a fluorine compound, and the perfluoropolymer fine particles carry the fluorine compound on surfaces thereof, and wherein the fluorine compound is a perfluoropolyether compound or a branched polymer compound having a perfluoroalkyl group.

10. An apparatus according to claim 1, wherein the information is related to an accumulated number of rotations of said intermediary transfer member.

11. An apparatus according to claim 1, wherein the information is related to an accumulated time period of rotation of said intermediary transfer member.

12. An apparatus according to claim 1, wherein when the accumulated use amount is greater than a predetermined amount which is greater than the second predetermined amount, said controller sets the permissible number to a constant number.

13. An apparatus according to claim 1, wherein the ambient condition of said apparatus is an absolute humidity in the ambience where said apparatus is placed.

14. An apparatus according to claim 1, wherein at the time of completion of the continuous image forming job, if the ambient condition sensed by said ambient condition sensor is the second condition, the accumulated use amount is less than the first predetermined amount, and the permissible number is less than the second permissible number and is more than a fourth permissible number which is less than the third permissible number, said controller forms second predetermined toner on said intermediary transfer member to supply the second predetermined toner to said blade after the completion of the continuous image forming job and before start of movement of said intermediary transfer member.

15. An image forming apparatus comprising:

an image forming portion configured to form a toner image;

an intermediary transfer member configured to receive the toner image formed by said image forming portion;

a blade configured to clean said intermediary transfer member by removing residual toner therefrom;

a memory configured to store information relating to an accumulated use amount of said intermediary transfer member from a fresh state thereof; and a controller configured to execute an operation in a mode in which predetermined toner for cleaning said intermediary transfer member is deposited on said intermediary transfer member in an area corresponding to a region between a preceding recording material and a succeeding recording material during execution of a continuous image forming job for continuously forming the images on the recording materials to supply the predetermined toner to said blade, wherein when the accumulated use amount is less than a first predetermined amount, said controller controls an amount of the predetermined toner to be supplied in the operation in the mode to be a first supply amount, wherein when the accumulated use amount is less than a second predetermined amount which is greater than the first predetermined amount, said controller controls the amount of the predetermined toner to be supplied in the operation in the mode to be a second supply amount which is greater than the first supply amount, and wherein the accumulated use amount is calculated with calibration depending on a size of the formed image.

* * * * *